United States Patent [19]

Hill et al.

[11] Patent Number: 5,072,620

[45] Date of Patent: Dec. 17, 1991

[54] STAMPING TOOL

[75] Inventors: Ronald C. Hill, Corfu; Richard M. Eckert, Amherst; Anthony Marzullo, Buffalo, all of N.Y.

[73] Assignee: Strippit, Inc., Akron, N.Y.

[21] Appl. No.: 416,392

[22] Filed: Oct. 2, 1989

[51] Int. Cl.[5] ..... B21J 13/00; B41J 1/54

[52] U.S. Cl. ..... 72/414; 72/442; 72/446; 83/530; 83/552; 83/571; 400/129; 400/131; 400/134

[58] Field of Search ..... 72/414, 404, 472, 442, 72/441, 446; 400/127, 129, 130, 131, 132, 134, 134.1, 134.2, 134.4, 134.5, 134.6; 83/552, 571, 530, 543, 549, 698; 101/18, 21, 29, 31; 100/53, 257

[56] References Cited

U.S. PATENT DOCUMENTS

| | | | |
|---|---|---|---|
| 1,504,598 | 8/1924 | Bergen | 83/552 X |
| 1,940,883 | 12/1933 | Rollings | 83/552 |
| 2,438,951 | 4/1948 | Stephens . | |
| 2,820,518 | 1/1958 | Shumaker . | |
| 3,174,377 | 3/1965 | Lischer | 83/525 |
| 3,178,983 | 4/1965 | Brunson | 83/530 |
| 3,400,657 | 9/1968 | Fulks | 400/132 X |
| 3,527,130 | 9/1970 | Knehans | 83/454 |
| 3,656,392 | 4/1972 | Krynytzky et al. | 83/530 |
| 4,096,798 | 6/1978 | Moskalik | 83/530 X |
| 4,165,669 | 8/1979 | Brown et al. | 83/552 |
| 4,166,415 | 9/1979 | Spanke et al. | 100/257 X |
| 4,220,062 | 9/1980 | Blanz | 83/71 |
| 4,250,785 | 2/1981 | Morishita et al. | 83/552 |
| 4,285,259 | 8/1981 | Jelinek et al. | 83/552 |
| 4,307,599 | 12/1981 | Wrona | 72/446 |
| 4,412,469 | 11/1983 | Hirata et al. | 83/552 |
| 4,532,845 | 8/1985 | Jinnouchi | 83/552 |
| 4,555,966 | 12/1985 | Klingel | 83/549 X |
| 4,569,267 | 2/1986 | Klingel | 83/552 |
| 4,658,688 | 4/1987 | Shah et al. | 83/552 |
| 4,790,173 | 12/1988 | Boutcher, Jr. | 83/530 X |
| 4,929,276 | 5/1990 | Chun et al. | 83/552 |

FOREIGN PATENT DOCUMENTS

| | | | |
|---|---|---|---|
| 2267170 | 11/1975 | France . | |
| 0181667 | 8/1986 | Japan | 400/130 |
| 657567 | 9/1986 | Switzerland . | |
| 2071554 | 9/1981 | United Kingdom . | |
| 2169233 | 10/1985 | United Kingdom . | |
| WO88/09232 | 12/1988 | United Kingdom . | |

OTHER PUBLICATIONS

Brochure entitled: Finn-Power Turret Punch Presses for the 21st Century, Copyright 1988, pp. 1-12.

Manual for Mate Finn-Power Multi-Tool, Copyright 1988, pp. 1-8.

Trumpf, Inc., News, Mar. 1988, vol. IV, No. 1, "Prestigious Visitors Help Kick off a Promising 1988: TM 400, TC 260 Rotation & TLF 500 Introduced".

The Fabricator, Jan./Feb. 1988, "New Feature Enhances Turret Punch Presses".

Article, Finn-Power Turret Punch Presses for the 21st Century, Copyright 1988, Finn-Power International, Inc.

*Primary Examiner*—Mark Rosenbaum

*Assistant Examiner*—Eugenia A. Jones

*Attorney, Agent, or Firm*—Hill, Van Santen, Steadman & Simpson

[57] ABSTRACT

A stamping tool for use in an auto-indexable tool station having a number of character inserts that can be rotatably moved below a striker area so that a thin metal plate or sheet of metal may be marked. The stamping tool allows for automatic adjustment of tool length for any variation in material thickness. A pneumatic cylinder actuates a mechanism that engages the key way in the head nut. The tool length is changed by the rotary motion of the auto-indexable tool station. The character housing is rotated by the indexable tool station through the punch key which moves the selected character insert to the striker area within the tool. The striker area causes the character insert which is spring biased to protrude lower than the character inserts that are not in the striker area. When the stamping tool is struck by the ram, only the character insert in the striker area will contact the material to be marked. Further, an overload protection mechanism is included to prevent any tool damage if the tool length is adjusted incorrectly. A control system provides an automatic sequence cycling of the indexing system to position each required stamping tool in an accurate stamping position. The tool has capacity for a full alphanumeric set which can be selected automatically through commands in a control program. These characters can be selected in any order to create a specific identification.

9 Claims, 3 Drawing Sheets

STAMPING TOOL

BACKGROUND OF THE INVENTION

1. Field of the Invention

The invention relates to a turret indexing system and more particularly to a stamping tool that positions tools for striking by a ram.

2. Description of the Prior Art

Turret type punch presses which are capable of accurately positioning different tools in a single system are well-known. Conventional presses are controlled by a central processor such as a computer. Such a press is disclosed in U.S. Pat. No. 4,285,259. Conventional punch presses have tool holders which are rotatably mounted in the turrets. The punching tools can be automatically and synchronously rotated or indexed in the upper and lower turrets to provide different orientations for the punching of holes by the tools. Such a turret indexing system is disclosed in U.S. Pat. No. 4,412,469. To improve performance, these presses include a means for simultaneous adjustment of the cutting height and stroke of each tool. The adjustment will be made according to the needs of the particular job. Such an adjustment system is disclosed in U.S. Pat. No. 3,174,377.

U.S. Pat. No 4,658,688, assigned to the assignee of the present application, discloses a punch press having multiple punch tool rotatable turrets wherein at least one of the punch tools on each of upper and lower turrets is indexable to different angular orientations. Rotation of the indexable punch tools is accomplished by a slidably mounted motor for engagement with a timing pulley, which through a timing belt and speed reducing element, acts to rotate the punch tools. A break and position sensors are also provided Synchronization of punch and die orientation is achieved through servos and control.

U.S. Pat. No. 4,569,267 discloses a punch press which uses a punch tool assembly which contains at least two punch pins of different diameters or cross-sections which are interchangeable in the working position by a control element which is slidable about the pin support member, and actuating means. When the punch tool assembly is rotatable about the ram to effect the movement of the punch pins from operative to inoperative positions, then a cooperating movable die is provided in order to ensure that the aligned die bores are cooperatively dimensioned and configured with respect to the punch pins. The punch tool assembly is held on the ram and moves with the ram and the pins, when not being used, are held in an elevated position while the operative pin is rigidly locked into a protruding position.

Prior art punch presses also utilize an overload protection system to prevent any damage. The press will be able to exert its thrust on the work up to a predetermined pressure, yielding to the overload release device to prevent damage. Such a device is disclosed in U.S. Pat. No. 2,438,851.

Most turret type presses are directed toward punching but can be adapted to stamping. Such a tool is produced by Finn Manufacturing. This tool requires movement of the striker area over the stationary character inserts to prepare them for striking by a ram. The means provided, for tool length adjustment and overload protection in the prior art is not appropriate for stamping because they lack the accuracy needed for optimum performance. Stamping requires precise adjustment to insure consistent depth of impression by the tool. Accordingly, a stamping tool with a turret indexing system having automatic adjustment of tool length and mechanism for overload protection when the tool length is not adjusted correctly, will be a decided advance in the state of the art.

SUMMARY OF THE INVENTION

An object of the invention is to provide an automatic stamping tool in a rapid turret indexing system for selectively positioning predetermined turret stamping tools in a stamping position relative to an operating ram to stamp required indentions in a work piece. The stamping tool is incorporated with other tools, such as punches, in the turret indexing system.

It is a further object of the present invention to provide an automatic turret indexing system for stamping which provides for overload protection of the press.

It is yet another object of the present invention to provide an automatic turret indexing system for stamping which has automatic tool length adjustment.

It is yet another object of the present invention to provide an automatic turret indexing system for stamping which has an entire alphanumeric set to enable the stamping tool to act in the manner of a typewriter.

The above objects are achieved according to the principles of the present invention.

A punch assembly is provided at a punching station in the turret, which punch assembly carries a plurality of individual punches. The punch assembly may be rotated so that a selected one of the plurality of punches will underlie a portion of the striker body acted upon by the ram which causes the selected punch to extend downwardly below the punch assembly so as to pierce the sheet material being acted upon.

Stripper buttons are held at a bottom portion of the punch assembly by undercut grooves which capture flanges on the buttons and by a rotatable circumferential ring extending around the entire periphery of the punch assembly which have spaced flanges to selectively overlie and capture the buttons. Thus, the buttons may be easily and quickly removed and replaced either when damaged, or when the punches are being changed.

The die holder receives a plurality of corresponding die buttons having openings therein corresponding to the punches. The buttons are also easily removable and replaceable and are held in specific orientations, as required, by keys which may be reversed in orientation. Set screws are used to hold the die buttons in place.

One of the assemblies in the turret is a stamping tool instead of a punching tool. The die buttons are modified to be solid or can be completely replaced by a block anvil. In the stamping tool, an upper turret provides a plurality of tools which are character inserts, each of which is spring biased upwardly in an individual seat in a character housing. A striker ring contains a single striker area with a spring-biased character tool directly therebelow. The character that is directly below the striker area will project further below the character housing than the other characters in the character housing. The striker ring is keyed to a non-rotatable ring which is carried by the turret itself outside of the indexable portion. As a result, the striker ring does not rotate.

The character housing, carrying the character inserts, rotates below the striker ring. Each of the character inserts may be rotated under the striker area by rotation of the indexed station which rotates the character housing. Individual characters can be located as desired under the striker area.

The character housing is keyed to a punch ring which is, in turn, threaded to a head nut. A spring will maintain pressure on the threads. The punch ring has a diameter reduction at the bottom and a flange at the character housing is entrapped between that diameter reduction ledge and a bolt/washer combination threaded into the punch ring. The striker ring is connected to the punch ring through an overload protection system such that the striker ring normally moves with the punch ring. Actuation of the ram will cause a stamping of the character indicia onto the work piece. The depth of stamping can be controlled by locking the head nut at the head nut way by a shotpin-type lock and then rotating the indexable station. The punch head is threaded in or out with respect to the punch ring to adjust stack height. The character stamping pressure will be controlled by the overload protection system. The alignment on the vertical and horizontal axes of the individual character can be controlled by appropriate rotation of the stamping tool constructed according to the principles of the present invention. As a result, an actual writing area can be produced on the work piece. By using alphanumerics for the character inserts in the character housing, the stamping tool can act in the manner of a typewriter.

DETAILED DESCRIPTION OF THE PREFERRED EMBODIMENT

Figure 1:
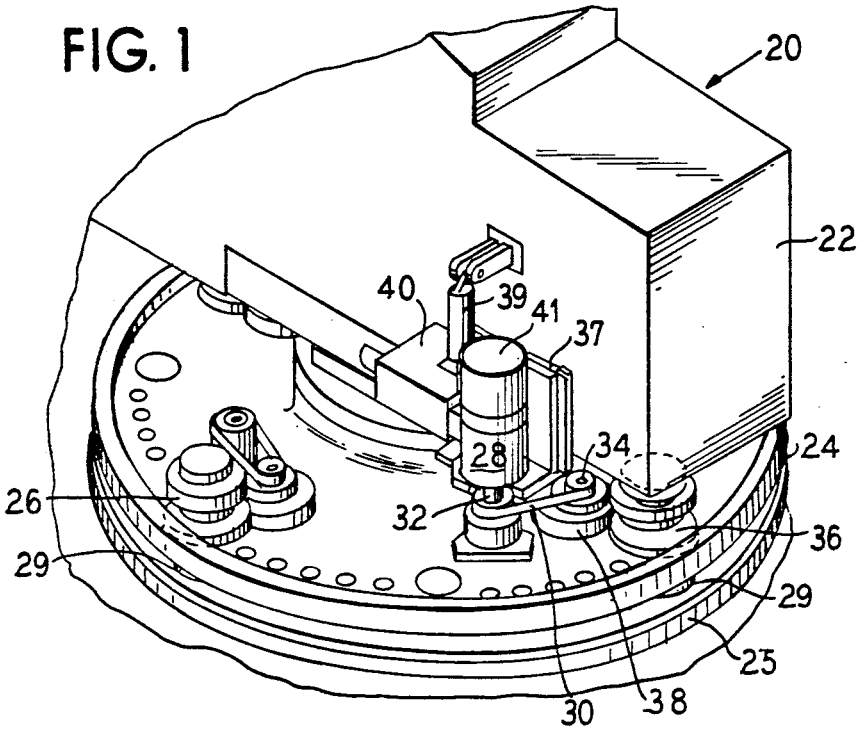
FIG. 1 is a perspective view of a turret indexing system which employs the stamping tool of the present invention.

Referring to FIG. 1, the device of the present invention is shown generally at 20 and includes a punch press housing 22, a rotatable turret 24, at least one indexable punching tool 26, and a punching tool drive motor 28.

The indexable punch 26 is provided with a geared bushing 36 that is rotatably driven by a speed reducing element 38 which in turn is driven by timing belt 30 connecting a pair of pulleys 32 and 34. The servo motor 28 is mounted on the punch press housing 22 by a vertical slide 37 and is selectively engageable to the drive pulley 32. Vertical movement of the servo motor 28 in the slide 37 is provided by an actuator 39 such as a pneumatic actuator, connected between the motor slide 37 and the punch press housing 22. The servo motor 28 may be locked into its respective upper and lower positions by a slide lock mechanism 40. A resolver 41 provides feedback from the motor 28 to a programmed controller (not shown) to monitor the angular rotation of the motor 28.

Figure 2:
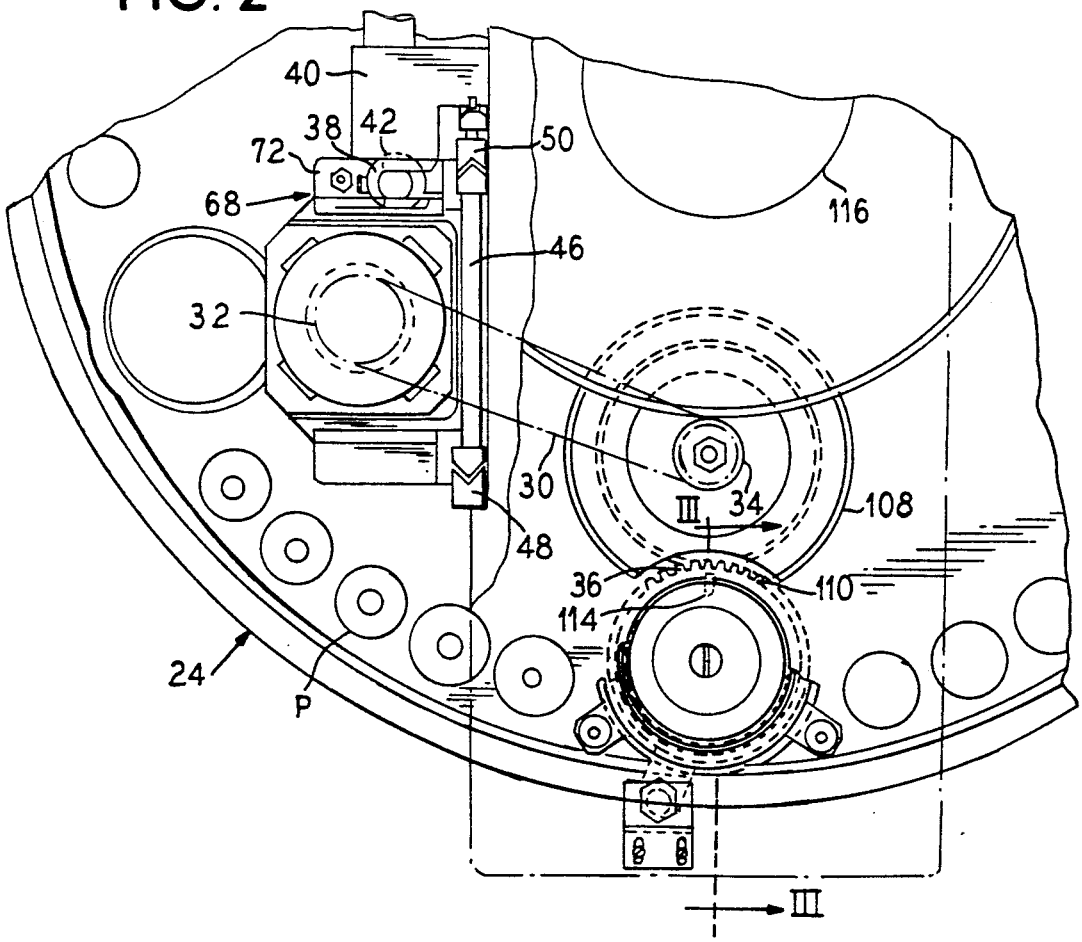
FIG. 2 is a plan view of a turret indexing system shown in FIG. 1.

FIG. 2 shows the upper turret 24 from above including a plurality of punches P. The slide plate 46 is mounted between the V-shaped slide rails 48 and 50. The pneumatic actuator 39 is seen suspended from the bracket 42 and the slide lock 40 and the arm 72 of the mechanical stop 68 can be seen more clearly. The timing belt 30 extends from the drive pulley 32 to the second pulley 34 under the housing 22. The speed reducing element 38 is enclosed by a housing 108 having a shaped opening 110 through which extends the geared bushing 16 of the indexable punch 26. The indexable punch 26 is keyed to the geared bushing 36 by a key 114. The turret 24 is rotatable about a turret axis 116 to bring other punch tools P under the ram 19.

Figure 3:
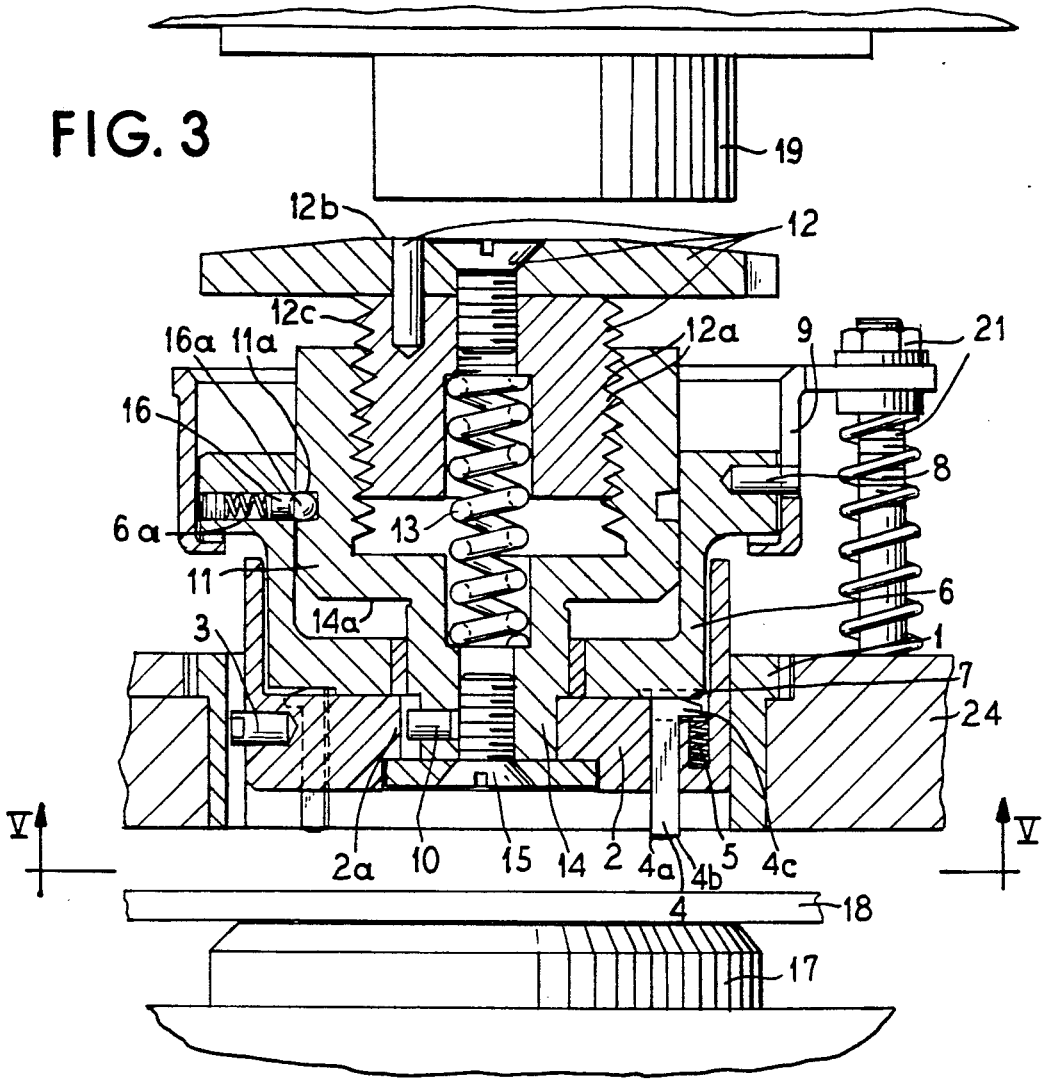
FIG. 3 is a cross-sectional view of the stamping tool with ram retracted shown in FIG. 2 along line III—III.

The stamping tool is employed as one of the tool assemblies in the turret auto indexing system. As in FIG. 3, a machine tool turret stamp is shown which includes an upper turret assembly 24 and a lower steel block or anvil 17. The upper turret indexing system has a ram assembly 19, an indexing station 20 capable of powered incremental rotation, a character housing 2 to carry character inserts 4 which are spring biased by a spring 5. A striker ring 6 contains a striker area 7 which provides for a seat for the character inserts 4 in the striker area 7. The striker ring 6 is keyed at 8 to a non-rotatable ring 9 which is carried by the turret itself outside the indexable portion. The character housing 2 rotates beneath the stationary striker ring 6.

The character housing is keyed at 10 to a punch ring 11 which, in turn, is threaded to a head nut combination 12 of a bolt **12*a*, a ramming surface 12*b*, and a threaded body 12*c*. A spring 13 maintains preload on threads 12*c*. The punch ring 11 has a diameter reduction 14 at the bottom forming a ledge 14*a* and a flange 2*a* of the character housing 2 is entrapped between that diameter reduction ledge 14*a* and a bolt/washer combination 15 threaded into the punch ring 11. The striker ring 6 is connected to the punch ring 11 through an overload protection 16 such that the striker ring 6 normally moves with the punch ring 11**.

The character housing 2 carries the character inserts 4. Each character insert 4 is rectangular in shape having a striking area **4*a*, as well as an alphanumeric stamp end 4*b*. The portion of the character insert that will be struck by this striker ring 6 has an overhang 4*c* which is used with spring 5 to bias character insert 4 upwardly. The character insert 4 will stay in place and maintain contact with striker ring 6. The striker area 7 of the striker ring 6, which is large enough to contact only one character insert at a time, has a surface area that is ramped downwardly to be lower than the rest of the contact surface of the striker ring 6. Spring 5 will keep character inserts 4 abutted against striker ring 6. The spring 5 for the character insert 4 that is below the low striker ring portion will compress to allow for the character insert in the striker area 7 to protrude below the character inserts not in the striker area. The character housing carrying character inserts rotates these character inserts 4 in and out of the striker area 7. During this time, the striker ring 6 is maintained in a stationary position and keyed at 8 to the ring 9. The character housing 2 is keyed at 10 to the punch ring 11 which is, in turn, threaded to the head nut combination 12. The head nut combination 12 may be screwed in and out of the punch ring 11. A spring 13 maintains preload on the threads 12*c* of head nut combination 12. Screwing in and out of head nut combination 12 will enable the tool length to be adjusted. Precise tool height can be achieved through limiting the vertical movement of the punch ring 11. A flange 2*a* of the character housing 2 fits into the diameter reduction area 14 of the punch ring 11. A bolt and washer combination 15 is threaded into the punch ring 11 to secure the character housing 2 vertically relative to the punch ring 11**.

The stamping tool is secured to turret 24 by a nut, bolt and spring combination 21. The combination 21 supports the stamping tool by attachment to the non-rotatable ring 9.

The present invention employs an overload protection system 16 to control the actual amount of character stamping pressure. The overload protection 16 connects the punch ring 11 to the striker ring 6. The punch ring 11 sits concentrically within the striker ring 6. A notch or groove 11*a* in the outside wall of punch ring 11 matches and is adjacent to a notch or blind hole 6*a* in the inside wall of the striker ring. The matching notches form a cavity which is filled by a spring-biased metal ball 16*a*. The notch and ball arrangement secures punch ring 11 to the striker ring 6. As a result, the striker ring 6 will move vertically in unison with the punch ring 11. This overload protection mechanism 16 will prevent damage to the tool when the tool length is not adjusted correctly in that the ball 16*a* will be forced out of the notch 11*a* when an excessive pressure is being exerted through the punch ring 11 to the character insert 4 and the punch ring 11 will move downwardly relative to the striker ring 6, thereby releasing the pressure on the character insert 4 through the striker ring 6.

Figure 4:
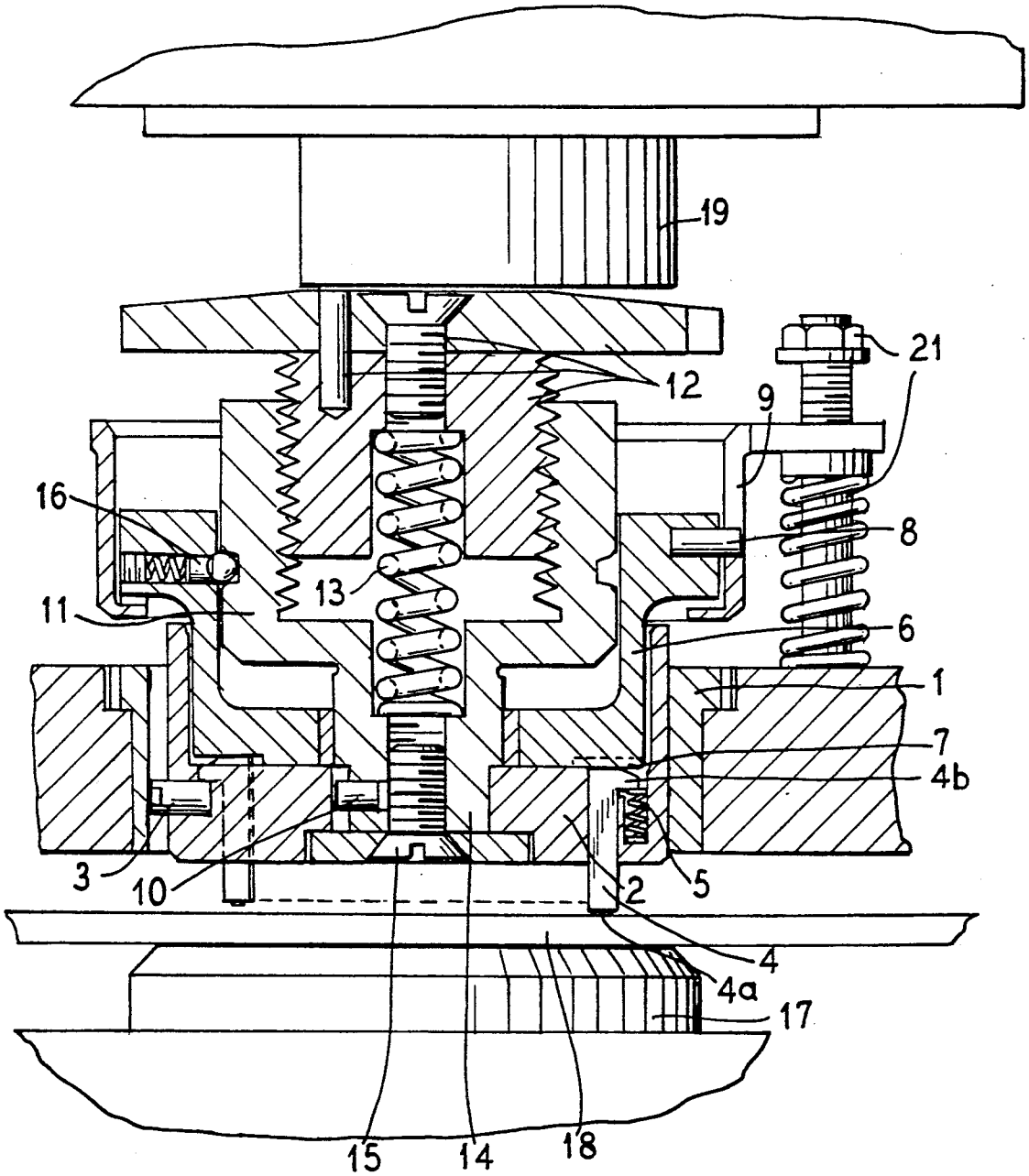
FIG. 4 is a cross-sectional view of the stamping tool with ram striking thereon shown in FIG. 2 along line III—III.

In operation, the head nut combination 12 is adjusted to achieve proper tool length. Then, the desired character inset will be rotatably moved beneath the striker area 7 of striker ring 6 as shown in FIG. 4, the ram 19 strikes the head nut combination 12 forcing the character insert 4 that is beneath the striker area 7 to then strike the surface of material 18. A block anvil 17 prevents the tool from penetrating the material while giving good support for the upper turret 24.

The control system (not shown) includes various standard system components, the specific details of which are well-known to those skilled in the art and do not, in themselves, form a part of this invention. A control system is programmed to rotate a character insert 4 into the striker area 7 under the portion of striker 6 that is lower than the rest of the striker ring, so that the ram 19 can strike the tool system and cause only the one character insert to contact the material. Since the character insert that is below the striker area 7 of the striker ring 6 protrudes lower than the other character inserts 4, it would be the only one to contact the material 18. After the first stamp is completed, the character housing is again rotated and a different character insert is rotated into the striker area of striker ring 6 so that it may protrude lower than the other character inserts 4. The entire workpiece material 18 is moved horizontally, laterally or longitudinally so that the next stamp will be adjacent to or otherwise spaced from the previous one. Such control of operation is programmed into the control system.

Figure 5:
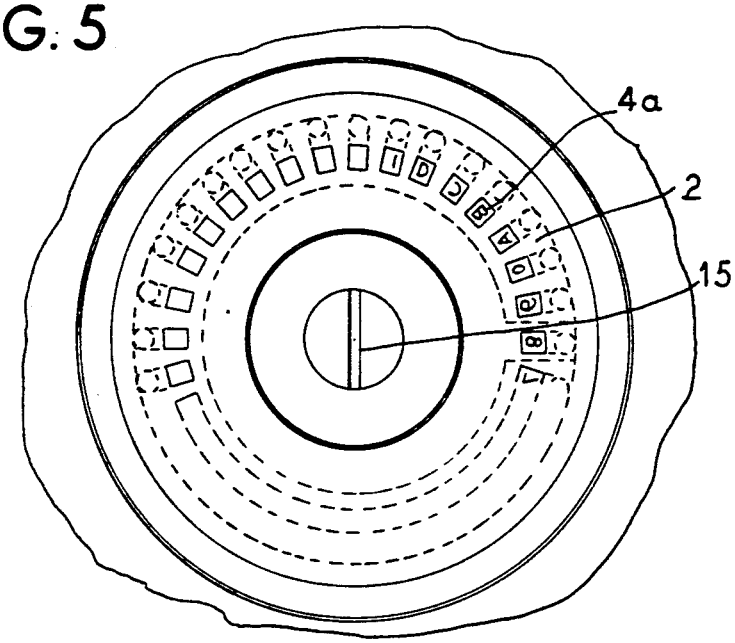
FIG. 5 is a bottom view of the stamping tool with individual character inserts shown in FIG. 3 taken generally along line V—V in FIG. 3.

FIG. 5 shows the bottom surfaces 4*a* of the character inserts 4 in character housing 2. Bolt/washer combination 15 secures the character housing 2 to the stamping tool. The character inserts 4 are equally spaced in the character housing. The circular arrangement allows for easy rotation of the character housing 2. Each character insert surface 4*a* has an alphanumeric character in relief so striking material 18 leaves an indicia. Precise stamping can be achieved while maintaining high operation speed. This stamping tool can be used in an auto-indexable tool station which allows for automatic adjustment of the tool length. Further, variation of the material thickness and automatic selection of the characters to be stamped are automatically controlled. These automatic functions are controlled through commands in the part program (N/C program) and servo control.

With the appropriate software, the alignment on the lateral and longitudinal axes of the individual character can be controlled by appropriate rotation of the stamping tool so that an actual writing area can be produced in the work piece. By laterally and longitudinally moving the workpiece, a series of spaced characters can be imprinted on the workpiece. By using an entire alphanumeric set of character inserts in the character housing, the stamping tool can act in the manner of a typewriter. Such a stamping tool used in an auto-indexable turret system provides great flexibility of position and depth of the stamp marking. The stamping tool of the present invention can be easily adjusted to accommodate materials of varying thickness and characteristics.

Although the teachings of our invention have herein been discussed with reference to a specific embodiment, it is to be understood that these are by way of illustration and that variations and modifications may be effected without departing from the spirit and scope of the novel concepts of our invention.

We claim as our invention:

1. A stamping tool for stamping indicia onto a work piece, comprising:

a plurality of stamping punches;

punch ring means for holding said plurality of punches at an elevated position relative to said work pieces;

striker ring means for selectively moving at least one of said punches at a time into an engagement position with respect to said work piece;

means for adjusting the distance said punches are moved from said elevated position to said engagement position; and said punch ring means and said striker ring means being connected by a releasable means such that said punch ring means and said striker ring means are capable of vertical movement in unison.

2. A stamping tool as claimed in claim 1, wherein said means for adjusting the distance said punches are moved includes an overload protection means to prevent any tool damage when said distance is not adjusted properly, said overload protection means controls stamping pressure of said stamping punches.

3. A stamping tool as claimed in claim 1, wherein said at least one of said punches is moved into a striker area so that only said at least one of said punches engages with said work piece, said striker area vertically moves said at least one of said punches closer to said work piece than said punches not in said striker area.

4. A stamping tool in an auto-indexable system for performing stamping operations on a work piece, comprising:

a ram selectively reciprocally movable along a vertical axis;

at least one indexing station rotatably carried in said stamping tool for rotation about a vertical axis;

means for selectively incrementally rotating said indexing station;

a character insert housing keyed to said indexing station for rotation therewith;

a plurality of character inserts carried in said character insert housing for projection therebelow;

biasing means carried by said character insert housing to bias said character inserts into an elevated position;

a striker ring having at least a portion thereof which overlies and is engageable with a selective one of said character inserts held in said character insert housing to move said character insert downwardly against said biasing means, said downwardly moved character insert projects farther below said character insert housing than said character inserts which are not downwardly moved;

a holding ring non-rotatably mounted in said stamping tool for carrying said striker ring;

said holding ring and said striker ring having engagement means therebetween to permit vertical movement between said holding ring and said striker ring, but preventing relative rotation between said holding ring and said striker ring;

a punch ring, carried within said striker ring, and being affixed to and keyed for rotation with said character housing;

a head nut carried in said punch ring to project thereabove;

said head nut being selectively vertically adjustable relative to said punch ring;

said head nut being engageable at a top surface thereof by said ram;

said striker ring and said punch ring being connected by a releasable means such that said striker ring and said punch ring are capable of vertical movement in unison; and wherein as said ram is moved downwardly it engages said head nut causing said head nut, punch ring, striker ring and character insert housing to move vertically downwardly with one of said character inserts pressed into a more downwardly position relative to other of said character inserts by said striker ring for engagement against said work piece.

5. A stamping tool as claimed in claim 4 wherein said releasable means connecting said punch ring and said striker ring comprises at least one overload protection means which prevent tool damage when said head nut is not adjusted correctly.

6. A stamping tool as claimed in claim 5, wherein said striker ring includes a striker area for downwardly biasing at least one of said plurality of character inserts, said striker area of said striker ring has a bottom edge that is lower than a portion of said striker ring not in said striker area.

7. A stamping tool according to claim 5, wherein said releasable protection means comprises a spring-biased ball bearing carried by said punch ring, said ball bearing being received in a notch in said striker ring.

8. A stamping tool according to claim 5, wherein said releasable protection means comprises a spring-biased ball bearing carried by said striker ring, said ball bearing being received in a notch in said punch ring.

9. A stamping tool for stamping indicia onto a work piece, said stamping tool comprising, in combination:

punch ring means for maintaining a plurality of stamping punches at a selectively predetermined elevated position relative to said work piece;

striker ring means for selectively moving a predetermined one of said punches into engagement with said work piece, said striker means being capable of movement with, and relative to, said punch ring means, along a common longitudinal axis; and overload protection means for selectively preventing relative movement between said punch ring means and said striker ring means, said overload protection means including a spring-biased element disposed between said punch ring means and said striker ring means and capable of reciprocating in a direction generally transverse to said longitudinal axis.

* * * * *